US006964381B2

(12) United States Patent
Stradella et al.

(10) Patent No.: US 6,964,381 B2
(45) Date of Patent: Nov. 15, 2005

(54) ATOMIZATION DEVICE WITH LATERAL ACTUATION

(75) Inventors: Fabio Stradella, Camogli (IT); Giuseppe Stradella, Camogli (IT)

(73) Assignee: Valois SAS, Le Neubourg (FR)

( * ) Notice: Subject to any disclaimer, the term of this patent is extended or adjusted under 35 U.S.C. 154(b) by 0 days.

(21) Appl. No.: 10/502,016

(22) PCT Filed: Nov. 19, 2002

(86) PCT No.: PCT/FR02/03957

§ 371 (c)(1),
(2), (4) Date: Feb. 23, 2005

(87) PCT Pub. No.: WO03/061843

PCT Pub. Date: Jul. 31, 2003

(65) Prior Publication Data

US 2005/0139615 A1 Jun. 30, 2005

(30) Foreign Application Priority Data

Jan. 22, 2002 (FR) ..... 02 00766

(51) Int. Cl.[7] ..... B05B 9/043

(52) U.S. Cl. ..... 239/333; 239/331; 239/337; 239/340; 222/321.6; 222/321.8; 222/402.13; 222/402.15; 222/507; 222/509; 128/200.14

(58) Field of Search ..... 239/329, 331, 239/333, 337, 340, 589, 569, 375; 222/321.1, 222/321.6, 321.8, 402.1, 402.13, 402.15, 222/505, 507, 509; 604/264, 275; 128/200.14, 128/200.22

(56) References Cited

U.S. PATENT DOCUMENTS

| | | | | |
|---|---|---|---|---|
| 3,272,391 A | | 9/1966 | Meshberg | |
| 3,323,690 A | | 6/1967 | Monahon | |
| 4,033,487 A | * | 7/1977 | Micallef | 222/321.6 |
| 4,077,549 A | * | 3/1978 | Beard | 222/402.15 |
| 4,264,038 A | * | 4/1981 | Nozawa | 239/333 |
| 4,271,990 A | * | 6/1981 | Kutik et al. | 239/333 |
| 5,370,313 A | * | 12/1994 | Beard | 239/337 |

FOREIGN PATENT DOCUMENTS

FR 2 781 772 A1 2/2000

* cited by examiner

*Primary Examiner*—Steven J. Ganey
(74) *Attorney, Agent, or Firm*—Sughrue Mion, PLLC

(57) ABSTRACT

A fluid spray device including a reservoir containing fluid, a dispenser head including a dispenser orifice, and an actuator device being on the dispenser head and co-operating with a fixing ring in order to actuate a pump or the valve, said actuator device including at least one actuator element pivotally mounted on said dispenser head, each actuator element including an actuator portion cooperating with said fixing ring, and a presser element on which the user exerts an actuation force, said presser element being pivotally mounted with respect to said dispenser head and extending firstly radially away from said dispenser head, and secondly axially towards the reservoir beyond said fixing ring, said actuator portion being pivotally mounted on said presser element and extending radially and axially towards the fixing ring so as to co-operate with said ring from below, when the device is in the upright position.

7 Claims, 1 Drawing Sheet

ATOMIZATION DEVICE WITH LATERAL ACTUATION

BACKGROUND OF THE INVENTION

The present invention relates to a fluid spray device, and more particularly to a fluid spray device in which the actuation force exerted by the user is directed in a direction that is different from the direction in which the fluid is sprayed through the spray orifice of the device.

Most fluid dispenser devices, whether they be perfume, medicine, or cosmetic dispensers, are made in such a manner that the user, when wishing to dispense a dose of fluid, exerts a force either on the dispenser head, or on the fluid reservoir, the force being directed axially in the displacement direction of the piston or of the valve of the device. That type of actuation is very practical for any device in which the spray direction is not axial, i.e. is not parallel to the displacement direction of the piston of the pump or the valve member of the valve of the device. In contrast, for a nasal spray in which the fluid is dispensed axially in order to project the dose of fluid into the nostril, that type of spray presents a certain number of drawbacks.

Thus, in particular, the fact that the force for actuating the device must be exerted in an axial direction implies that it is difficult to hold the nasal endpiece still inside the nostril while dispensing. In addition, that type of actuation can require a certain amount of force to overcome the precompression of the pump or of the valve, which can present difficulties for certain people such as the elderly or children, and which can, in extreme cases, also lead to injury to the inside of the nostril. In addition, that type of device is relatively difficult to actuate by a third person who is unable to sense contact of the nasal endpiece inside the nostril.

An object of the present invention is to provide a fluid spray device which does not reproduce the above-mentioned drawbacks.

In particular, an object of the present invention is to provide a fluid spray device which is simple and inexpensive to manufacture and to assemble, and which can be adapted to any type of presently-available pump or valve, without needing to modify the design of the pump or the valve, or of the fixing ring which fixes the pump or the valve on the reservoir.

Another object of the present invention is to provide such a fluid spray device which is simple to actuate, in particular in a nasal application.

Another object of the present invention is to provide such a fluid spray device which enables the dispenser orifice of the device to be held still inside the nostril while the device is being actuated.

SUMMARY OF THE INVENTION

The present invention therefore provides a fluid spray device including a reservoir containing fluid; a pump or a valve mounted on the reservoir by means of a fixing ring for selectively dispensing the fluid; and a dispenser head including a dispenser orifice, the device further including an actuator device that is displaceable between a rest position and a dispensing position, the actuator device being displaced in a direction that is different from the direction in which the fluid is sprayed through the dispenser orifice, said actuator device being on the dispenser head, and co-operating with the fixing ring in order to actuate the pump or the valve, said actuator device including at least one actuator element pivotally mounted with respect to said dispenser head, each actuator element including an actuator portion co-operating with said fixing ring, and a presser element on which the user exerts an actuation force, said presser element being pivotally mounted with respect to said dispenser head and extending firstly radially away from said dispenser head, and secondly axially towards the reservoir beyond said fixing ring, said actuator portion being pivotally mounted on said presser element and extending radially and axially towards the fixing ring so as to co-operate with said ring from below, when the device is in the upright position.

Said dispenser head advantageously includes a lateral skirt, said actuator device being formed in said lateral skirt.

Advantageously, said actuator device is made integrally as a single piece with said dispenser head.

Said actuator device advantageously includes two actuator elements that are diametrally opposite about said dispenser head.

The actuator device advantageously includes a precompression element, so that the pump or the valve is actuated only when the precompression threshold is overcome by the user.

The dispenser head is advantageously a nasal dispenser head, which, during actuation of the pump or the valve, remains steady in position in the user's nostril.

Other characteristics and advantages of the present invention appear more clearly from the following detailed description of an embodiment of the present invention, given by way of non-limiting example, and with reference to the accompanying drawing, in which:

DETAILED DESCRIPTION OF THE EXEMPLARY EMBODIMENT

Figure 2:
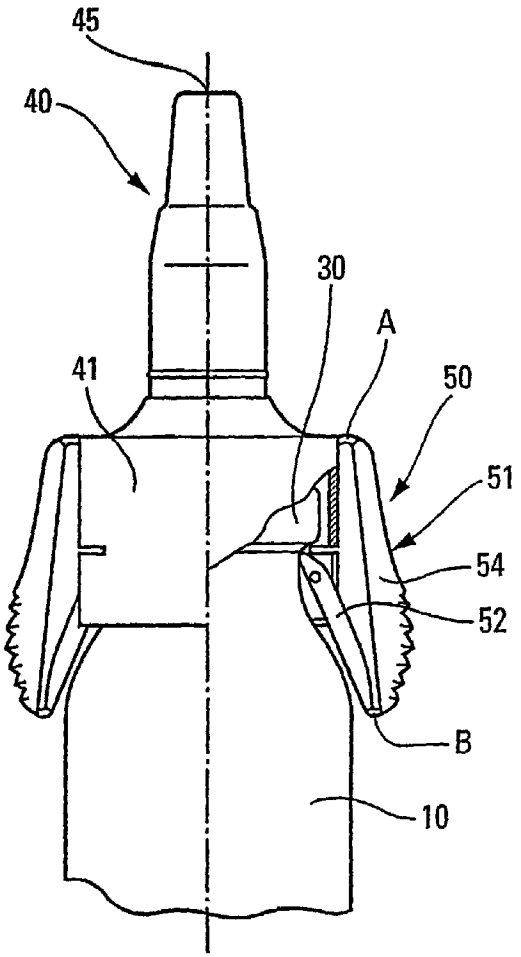
FIG. 2 is a view similar to that of FIG. 1, during actuation.

With reference to the figures, the spray device of the invention comprises a reservoir 10 which contains the fluid to be dispensed, and a pump or a valve (not shown) mounted on the reservoir 10 by means of a fixing ring 30, which can be a ring that is screwed, clamped, or snap-fastened onto the neck of the reservoir. The fixing ring is preferably standard, i.e. it is not modified relative to rings used in existing devices that do not include laterally-actuated systems. The pump or the valve serves to dispense the fluid selectively through a dispenser orifice 45 provided in a dispenser head 40. In this example, the dispenser head 40 is a nasal dispenser head, in which the orifice 45 is disposed in axial manner in order to dispense the fluid inside the nostril.

Naturally, the present invention is not necessarily limited to a nasal application, but applies to any type of fluid dispenser device. Its use in a nasal-type dispenser device does however present the above-mentioned advantages.

In the invention, the spray device includes an actuator system 50 which is formed on or secured to the dispenser head 40, the displacement direction of the actuator device 50 being different from the direction in which the fluid is sprayed through the dispenser orifice 45. More specifically, the displacement direction of the actuator device 50 is advantageously approximately perpendicular to the direction in which the fluid is sprayed through the dispenser orifice 45, it being understood that as a function of the embodiment selected for the actuator device, in particular since it is a pivoting element, said direction is not always exactly perpendicular.

In the example shown in the figures, the actuator system 50 includes at least one actuator element 51 pivotally mounted with respect to the dispenser head 40. The dispenser head 40 preferably includes a lateral skirt 41 provided with two diametrally opposite actuator elements 51 that are advantageously made integrally as a single piece with the head 40. In the invention, the actuator elements 51 acts on the fixing ring 30 in order to actuate the pump or valve. The actuator elements 51 advantageously co-operate with the corner formed by the bottom end of the fixing ring 30 and the neck of the reservoir 10, as can be seen in the figures. The user therefore places the dispenser head 40 in a nostril, and actuates the elements 51 in order to dispense a dose of fluid, said actuation being performed laterally so that the device remains stationary inside the nostril while dispensing, with no axial force being exerted on the device.

In the invention, the actuator elements 51 are pivotally mounted with respect to the dispenser head 40. Each actuator element 51 includes an actuator portion 52 which co-operates with the fixing ring 30, and a presser element 54 on which the user' presses in order to actuate the device.

Figure 1:
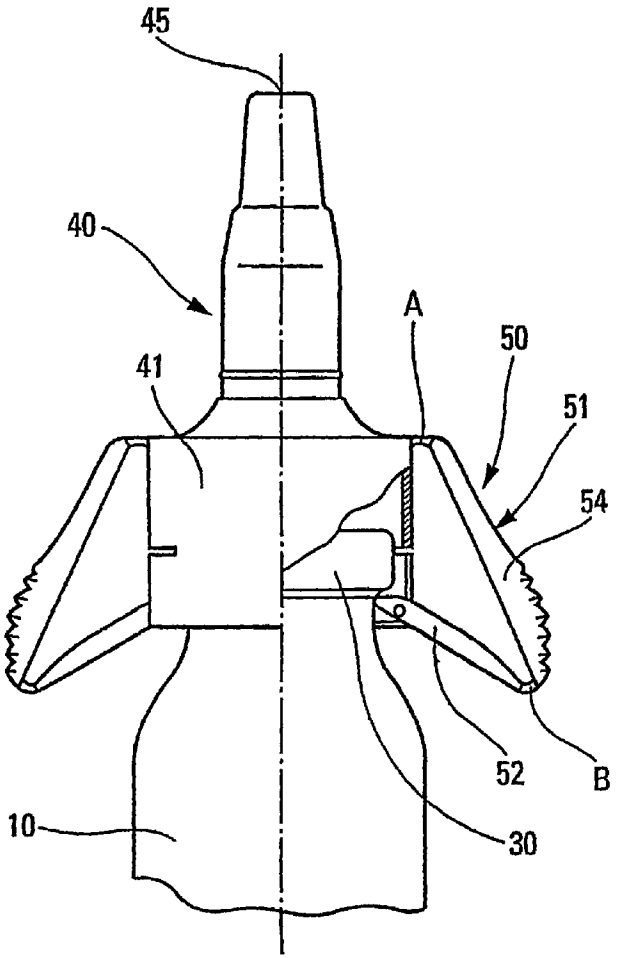
FIG. 1 is a diagrammatic section view of a device constituting an advantageous embodiment of the present invention, before actuation.

The presser element 54 is pivotally mounted at A on the head 40 and extends radially away from said head. The presser element also extends axially towards the reservoir 10 (downwards in the figures), beyond the fixing ring 30, as can be seen in FIG. 1. The actuator portion 52 is pivotally mounted at B on said presser element 54, preferably at its end. It extends towards the fixing ring 30 both radially and axially, thereby signifying that it is directed radially towards the device and axially towards the dispensing orifice 45. Thus, the actuator portion comes to co-operate with the fixing ring 30 from below, when in the upright position shown in the drawings. Thus, the ring 30 does not need to be modified in order to incorporate specific parts co-operating with the laterally-actuated system 50, and a standard ring can be used. The actuator system 50, and more particularly the actuator portion 52, co-operates with the portion of the ring 30 which becomes engaged under the neck of the reservoir 10. By avoiding the need to modify the fixing ring, the present invention reduces the cost of manufacturing and assembling the device. In addition, the dimensions of the device, in particular the radial dimensions of the reservoir and of the fixing ring are kept to a minimum despite the presence of the laterally-actuated system 50.

The laterally-actuated element 50 acts like a progressive lever system in which the transformation of the laterally-actuated force exerted by the user on the presser elements 54 into an axial force for actuating the pump is at a maximum at the end of actuation, when the resistance of the pump or valve is at its greatest. The system of the invention is therefore particularly effective.

Advantageously, a precompression element (not shown) can be provided which enables the pump or the valve to be actuated only when the precompression threshold is overcome by the user. This ensures that the entire dose is dispensed, and prevents the device from being partially actuated.

Another advantage of a laterally-actuated system that is on the head, and that does not co-operate directly with the tank, is that it can be adapted to any type, shape, and size of reservoir. It is not necessary to design a specific actuator system for each reservoir.

Naturally, the invention is therefore not limited to the embodiment shown in the drawings, and the person skilled in the art can carry out any necessary modifications without going beyond the ambit of the invention as defined by the accompanying claims.

What is claimed is:

1. A fluid spray device comprising a reservoir (10) containing fluid; a pump or a valve mounted on the reservoir (10) by means of a fixing ring (30) for selectively dispensing the fluid; and a dispenser head (40) including a dispenser orifice (45), the device further comprising an actuator device (50) that is displaceable between a rest position and a dispensing position, the actuator device (50) being displaced in a direction that is different from the direction in which the fluid is sprayed through the dispenser orifice (45), said actuator device (50) being on the dispenser head (40), and co-operating with the fixing ring (30) in order to actuate the pump or the valve, said actuator device (50) including at least one actuator element (51) pivotally mounted with respect to said dispenser head (40), the fluid spray device being characterized in that each actuator element (51) includes an actuator portion (52) cooperating with said fixing ring (30), and a presser element (54) on which the user exerts an actuation force, said presser element (54) being pivotally mounted on said dispenser head (40) and extending firstly radially away from said dispenser head (40), and secondly axially towards the reservoir (10) beyond said fixing ring (30), said actuator portion (52) being pivotally mounted with respect to said presser element (54) and extending radially and axially towards the fixing ring (30) so as to co-operate with said ring from below, when the device is in the upright position.

2. A device according to claim 1, in which said dispenser head (40) includes a lateral skirt (41), said actuator device (50) being formed in said lateral skirt (41).

3. A device according to claim 1, in which said actuator device (50) is made integrally as a single piece with said dispenser head (40).

4. A device according to claim 1, in which said actuator device (50) includes two actuator elements (51) that are diametrally opposite about said dispenser head (40).

5. A device according to claim 1, in which the fixing ring (30) is a standard ring that is screwed, snap-fastened, or clamped onto the neck of the reservoir (10).

6. A device according to claim 1, in which the actuator device (50) includes a precompression element, so that the pump or the valve is actuated only when the precompression threshold is overcome by the user.

7. A device according to claim 1, in which the dispenser head (40) is a nasal dispenser head, which, during actuation of the pump or the valve, remains steady in position in the user's nostril.

* * * * *